United States Patent [19]

Hatcher

[11] 4,168,863

[45] Sep. 25, 1979

[54] METHOD OF MAKING A SCOURING PAD

[76] Inventor: Rosemarie Hatcher, 9644 Clancey St., Downey, Calif. 90240

[21] Appl. No.: 885,428

[22] Filed: Mar. 13, 1978

[51] Int. Cl.[2] ..... A47L 17/08

[52] U.S. Cl. ..... 300/21; 15/209 B; 156/191

[58] Field of Search ..... 15/209 B, 209 C, 225, 15/226, 208, 209 R; 300/21

[56] References Cited

U.S. PATENT DOCUMENTS

| | | | |
|---|---|---|---|
| 1,689,207 | 10/1928 | Kingman | 15/209 B |
| 2,152,697 | 4/1939 | Kingman | 15/209 B |
| 2,424,747 | 7/1947 | Ellis | 15/209 B |
| 2,857,610 | 10/1958 | Rympalski | 15/209 B |
| 3,146,479 | 9/1964 | Stoker | 15/209 B X |

*Primary Examiner*—Daniel Blum

*Attorney, Agent, or Firm*—Knobbe, Martens, Olson, Hubbard & Bear

[57] ABSTRACT

A method of making a scouring pad from a length of nylon fabric netting characterized by forming the netting into a tube-like configuration by rolling the netting around two spaced cylinders having unequal diameters, but axially spaced from each other, twisting the tube of netting to gather the netting in the location between the two cylinders, folding the netting onto itself by extending one cylinder over the other cylinder to form one end of the pad, removing both cylinders from the netting tube, wrinkling and tucking the netting toward the other end of the pad to form an inside core, gathering the outside netting around the inside core, and twisting and tieing the outside netting to form the other end of the pad. The scouring pad may be made from a single length of fabric netting or alternatively made from two separate differing colored lengths, thereby resulting in a two-toned pad wherein the color of the inner core netting and outside netting are dissimilar.

14 Claims, 10 Drawing Figures

FIG. 1.
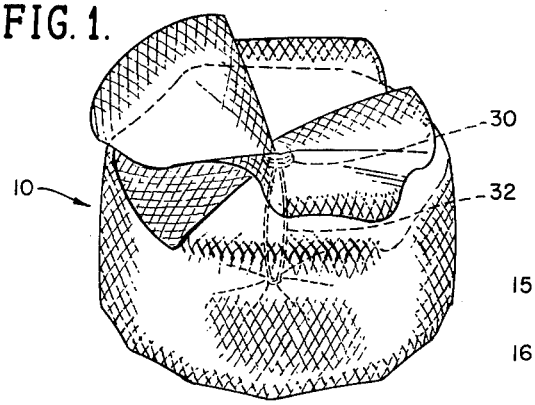
FIG. 10.
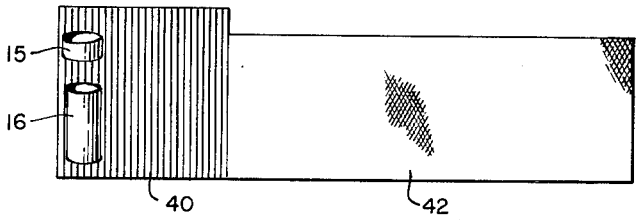
FIG. 2.
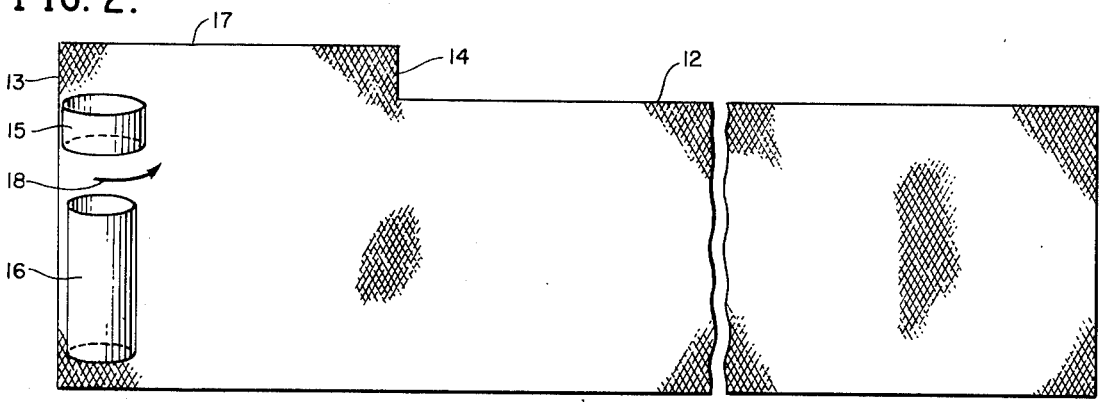
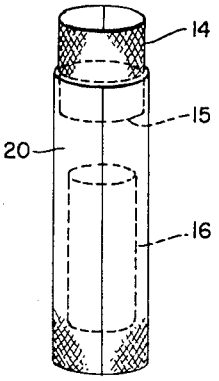
FIG. 3.
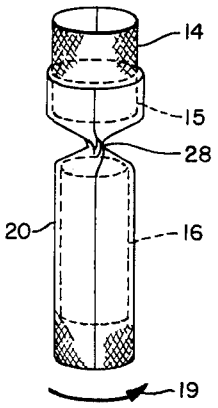
FIG. 4.
FIG. 5.
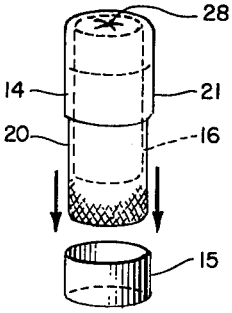
FIG. 6.
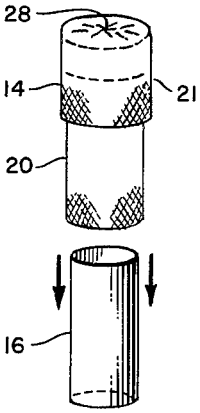
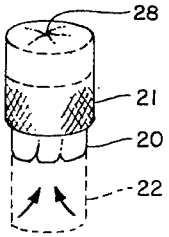
FIG. 7.
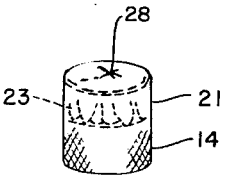
FIG. 8.
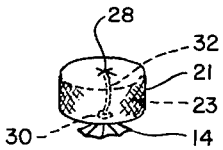
FIG. 9.

METHOD OF MAKING A SCOURING PAD

BACKGROUND OF THE INVENTION

A large variety of hand held cleaning devices have been previously developed to scour and polish various objects and surfaces. Such devices have been marketed throughout the world and are well-known to the general public.

The vast majority of these scouring devices utilize elongate strands or ribbons which are compressed or spirally wound upon themselves and formed into a ball, pad or wafer which may be held in the users hand. Typically, these devices are composed of metallic material such as steel wool, stainless steel, or copper which provide a plurality of sharp edges to remove grease or dirt particles.

In recent years with the advent of synthetic materials, plastic, nylon and rayon fibers have been utilized in scouring pad applications. These synthetic materials may be easily produced into a fabric netting having a cell-like structure which provides a plurality of scouring edges. The netting may then be formed into a pad or ball and provide a suitable scouring device.

Although these prior art devices have proven useful in many scouring applications, there are inherent deficiencies associated with their use.

The metallic scouring pads typically scratch the surface of many objects being cleaned and often cause minor skin irritations to the user. Additionally, pads made from steel wool or copper ribbon, rapidly oxidize when exposed to water and frequently shred or deteriorate during use.

Alternatively, the synthetic material pads, although not subject to oxidation, are typically maintained in a definite shape by a mechanical fastener such as a staple or wire which often mark or scratches the surface being cleaned. Further, most of the prior art synthetic pads have been formed in a configuration which is awkward to hold.

SUMMARY OF THE PRESENT INVENTION

The present invention provides a nylon mesh scouring pad which easily conforms to the hand of a user and is formed by a simple but unique method which eliminates the necessity of using a mechanical fastener. The scouring pad is sufficiently strong to remove stubborn dirt and grease particles from surfaces yet soft enough to prevent skin irritation during use. Further, the scouring pad is relatively inexpensive to produce and capable of prolonged usage without shreding or tearing. Such material is also easily cleaned by hand or machine washed.

A substantially rectangular length of mesh or netting made of nylon or other such material is formed into a tube-like configuration by suitable means such as rolling the netting around two unequal diameter cylinders. The netting tube is then twisted and gathered together in the vacinity between the two cylinders and subsequently inverted or doubled over onto itself by extending one cylinder over the other to form one end of the pad. The smaller diameter cylinder is then removed and the inner open end of the netting is wrinkled and tucked toward the twisted end previously formed, and retained in a powder-puff configuration by a single tie of a small nylon cord on the outer open end of the pad. The larger diameter cylinder may be then removed or it may be removed before the tucking operation.

These and other features of the method of the present invention will become more apparent upon reference to the drawings wherein:

FIG. 1 is a perspective view of the scouring pad made in conformity with the method stated herein;

FIG. 2 is a schematic perspective view illustrating the first step in the formation of the scouring pad from a length of nylon netting wherein the netting is rolled around two unequal diameter cylinders;

FIG. 3 is a perspective view illustrating the tube-like configuration formed by the nylon netting rolled about the two cylinders;

FIG. 4 is a perspective view illustrating the twist formed in the netting tube between the two cylinders;

FIG. 5 is a perspective view illustrating the doubling over of the netting tube upon itself to form one end of the pad by extending one cylinder over the other;

FIG. 6 is a perspective view illustrating the configuration of the netting tube after both cylinders are removed;

FIG. 7 is a perspective view illustrating the wrinkling and tucking of the nylon netting to form the interior netting core of the pad;

FIG. 8 is a perspective view illustrating the spacial relationship between the interior netting core and the outer netting of the pad;

FIG. 9 is a perspective view illustrating the gathering of the outer netting around the interior netting core and the subsequent tieing of the nylon cord; and FIG. 10 is a schematic, perspective view illustrating the first step in the formation of a dual-toned scouring pad wherein two different colored netting lengths are overlapped upon each other.

DETAILED DESCRIPTION OF THE PREFERRED EMBODIMENT

Referring to FIG. 1 there is shown the scouring pad 10, preferably made of nylon mesh or netting, which is provided with a nylon cord tie 30 at one end thereof. In the preferred embodiment, the pad 10 is substantially cylindrical in configuration, having an outside diameter of approximately three inches and a vertical height of approximately one and one-half inches, thereby being easily held in the hand of the user. A thin nylon cord 32 may be threaded through the axis of the pad 10 to form a loop which draws together and maintains the maximum vertical distance between the two ends of the pad 10.

Referring to FIGS. 2 through 9, the method for producing the scouring pad 10 may be described. The nylon fabric mesh or netting 12 is positioned as shown in FIG. 2 and is formed in a substantially rectangular pattern, perferably having an oversized netting section 14 extending partially down the length of one side of the fabric. This oversized section 14 provides excess netting material for ease in the subsequent tieing of the pad 10 but may be omitted without significantly altering the appearance of the pad 10.

The dimensions of the netting 12 may be varied depending upon the desired size of the pad 10. However, the applicant has discovered a suitable hand held pad may be produced using approximately a $10 \times 45$ inch rectangular pattern having an oversized section 14 of approximately $2 \times 12$ inches.

Two axially aligned cylinders 15 and 16 spaced from each other are positioned adjacent the larger end 13 of the netting 12. The outside diameter of the cylinder 16 is slightly smaller than the inside diameter of the cylinder 15 to enable the cylinder 15 to slip over cylinder 16. The applicant has found that a half-inch differential between the inside and outside diameters of the cylinders 15 and 16 respectively is desirable.

The axial dimensions of the cylinders 15 and 16 are not critical in that such does not affect the size of the pad 10. In the embodiment shown, they are approximately one and one-half and five and one-half inches respectively, but having both cylinders the length of the cylinder 15 is convenient also. Typically the cylinder 15 is positioned approximately two inches below the top edge 17 of the enlarged netting section 14, or aligned with the edge of the main section 12. Cylinder 16 having its axis aligned with that of cylinder 15 is positioned directly beneath cylinder 15 and typically spaced approximately three inches therefrom.

Starting at end 13 as shown in FIG. 2, the netting 12 is rolled throughout its entire length about the two cylinders 15 and 16 in the direction indicated by the arrow 18. By this rolling process, the netting length 12 is formed into a tube-like configuration 20 (as shown in FIG. 3) with the enlarged netting section 14 extending vertically above the cylinder 15 and a small segment of the netting 12 extending below cylinder 16.

Subsequently, as shown in FIG. 4, the netting tube 20 is restricted or gathered together at a location 28 between the two cylinders 15 and 16 thereby forming an upper and lower tube section. Preferably, this gathering is accomplished by a twisting procedure wherein cylinder 15 is held in a stationary position as cylinder 16 is simultaneously rotated in a direction indicated by arrow 19. Alternatively, the netting tube 20 may be gathered and tied with a small nylon cord (not shown) to maintain this restriction at point 28.

The formation of one end of the pad 10 (as shown in FIG. 5) is then accomplished by inverting or doubling over the netting tube 20 onto itself by extending the cylinder 15 over cylinder 16. This extension wherein cylinder 15 is subsequently removed from the netting tube 20, (as indicated by the two arrows in FIG. 5) forms an inverted tube section or netting cup 21 composed of the enlarged netting section 14 and the netting 12 previously formed about the cylinder 15, which extends partially down the length of the netting tube 20 and cylinder 16. At this time, the configuration (i.e. with the outer netting cup 21 extending partially over the netting tube 20) is self-maintained and therefore the cylinder 16 (as shown in FIG. 6) may also be removed from the netting tube 20.

Referring to FIG. 7, the lower section of the netting tube 20 is randomly wrinkled and tucked within the outer netting cup 21 from its former configuration indicated by the dotted line 22. This wrinkling and tucking procedure is continued until all of the lower section of the netting tube 20 is compressed within the outer netting cup 21 and confined above that portion of the netting cup 21 formed by the enlarged netting section 14 (as shown in FIG. 8). When compressed in this manner, the lower portion of the netting tube 20 forms the inner netting core 23 of the scouring pad 20.

Subsequently, referring to FIG. 9, the enlarged netting section 14 of the outer netting cup 21 is gathered around the inner netting core 23, preferably at a point spaced slightly from the free end of the outer section 21. The enlarged netting section 14 is then tied at the gathering point with the thin cord, preferably made of nylon, to retain a powder-puff like configuration and form the other end of the scouring pad 10. The free end of the outer section 21 thus flares outwardly to provide a bow-like decorative effect. After tying the nylon cord 30, an additional nylon cord 32 may be threaded through the axis of the pad 10 to form a loop (as shown in FIGS. 9 and 1) which draws together and constricts the vertical distance between the two ends of the scouring pad 10. Instead of the free end of the outer section flaring outwardly like a bow, the free end may be gathered and tucked inwardly toward the twisted end of the pad and fastened in this position by a cord tied to the twisted end.

As an alternative approach that has a number of advantages, the steps relating to FIGS. 5, 6 and 7 may be performed in a somewhat different manner and sequence. Referring to FIG. 5, instead of moving the cylinder 15 completely off of the fabric tube 20, it may be positioned over the end of the cylinder 16 with the upper ends of the cylinders about level with each other and with the closed end of the netting cup 21. The open end of the netting cup is not extended beyond the lower end of the cylinder 15 at that time, but instead is still folded to extend upwardly over the cylinder 15.

The smaller diameter cylinder 16 is then withdrawn as in FIG. 6, and the lower section of the netting tube 20 is then tucked and pressed within the netting cup 21, as in FIG. 7, but with the cylinder 15 still in position. The advantage of this approach is that the free end of the netting cup, being folded over the cylinder 15, cannot interfere with the tucking of the lower end of the fabric tube into the cup. Further, the cylinder 15 provides support and rigidity to facilitate the tucking of the the fabric into the netting cup 21. In this regard, the cylinder 15 may be closed on its upper end so as to further provide support during the tucking operation.

Once the lower end of the netting tube 20 has been tucked into the netting cup 21, the netting section 14 surrounding the cylinder 15 can be folded downwardly into the position shown in FIGS. 5–8. If the cylinder 15 does not have a closed upper end, the netting section 14 may be moved downwardly into the position shown in FIG. 5 by moving the cylinder 15 downwardly relative to the netting, as shown in FIG. 5. Alternatively, the cylinder 15, with or without a closed end, may be maintained in position until the bow tieing operation is completed, and then removed. If the cylinder has a closed end, it is of course removed by moving it upwardly as viewed in FIG. 5, which is opposite to the direction the cylinder is moved when the upper tube section is being inverted on the lower section. If the netting section 14 is to be tucked inwardly and not tied into a bow, the cylinder 15 would be removed at the completion of the tucking operation so as to permit the ends of the pad to be tied together.

One of the advantages of the invention is that the procedure for forming the pad is simple and may be easily manually performed by unskilled personnel or alternatively may be readily mechanized In this connection, the closed end cylinder 15 referred to above may be particularly advantageous for providing support in a mechanized approach.

In describing the invention above, certain references were made to the upper and lower edges of the cylinders and the netting tube and section. This, of course, was merely for convenience of description, and the tube may be oriented in any direction, including inverted from the positions shown in FIGS. 3–9.

Referring to FIG. 10, a simple modification of the first step in the method of the present invention results in the formation of a dual-toned scouring pad 10. In this modification, two separate different colored lengths of mesh or netting 40 and 42 respectively are utilized to form the scouring pad 10. These two netting lengths 40 and 42 are positioned as shown in FIG. 2, with length 42 slightly overlapping the length 40 by approximately one to two inches.

Subsequently the same method steps previously described and illustrated in FIGS. 2 through 9 are utilized to produce the scouring pad 10. In this modification, however, the inner netting core 23 (referring to FIG. 8) is predominately composed of the netting length 42 (as shown in FIGS. 10) whereas the larger netting section 14 of the outer netting cup 21 (referring to FIG. 8) is composed exclusively of the netting length 40. Thus, it can be easily recognized that by use of differing colored netting lengths, the scouring pad possesses an esthetically pleasing two-toned appearance wherein the color of the inner netting core and outer netting are dissimilar.

What is claimed is:

1. A method of making a scouring pad from a fabric member of scouring material comprising the steps of:

rolling said fabric member along its length about two axially aligned, axially spaced forming members of unequal cross-sectional area to form a tube;

gathering said tube intermediate the ends thereof to form first and second tube sections;

inverting said first tube section over and around said second tube section so that the gathered portion forms one end of said pad, said first tube section when inverted extending over said second tube section;

wrinkling and compressing said second tube section within said inverted first tube section to form a fabric core;

gathering said inverted first tube section around said fabric core to envelope said core and form the other end of said pad; and fastening said other end of said pad.

2. The method of claim 1 wherein at least one of said forming members comprises a tube having an inside diameter greater than the cross-sectional area of said other of said forming members.

3. The method of claim 2 wherein the inverting of said first tube section is accomplished by axially moving one of said forming members over the other of said forming members.

4. The method of claim 1 wherein said gathering of said first tube section around said core is at a point spaced from the free end of said first tube section, and said fastening is at said point so that said free end can flare outwardly to provide a decorative effect to the pad.

5. A method of making a scouring pad from a fabric member of scouring material comprising the steps of:

rolling said fabric member simultaneously about first and second cylinders to form a fabric tube, said cylinders being axially aligned but spaced axially, the inside diameter of said first cylinder being greater than the outside diameter of said second cylinder;

gathering said fabric tube together intermediate the ends thereof in the space between said first and second cylinders to form first and second tube sections;

inverting said first tube section over and around said second tube section by extending said first cylinder at least partially over said second cylinder to form a netting cup;

removing said second cylinder from said second tube section;

wrinkling and compressing said second tube section within said netting cup to form a fabric core;

gathering said inverted first tube section around said fabric core to envelop said core to form the other end of said pad; and fastening said other end of said pad.

6. The method of claim 5 wherein said fabric member is a nylon mesh or netted fabric.

7. The method of claim 5 wherein said fabric member is an elongate, generally rectangular section.

8. The method of claim 7 wherein said elongate fabric member is composed of one or more differing colored fabric sections.

9. The method of claim 5 wherein said gathering of said fabric tube is accomplished by twisting one of said cylinders relative to the other to restrict said tube.

10. The method of claim 5 wherein a nylon cord tie fastens said other end of said pad.

11. The method of claim 5 including removing said second cylinder from said second tube section before the wrinkling and compressing step, and removing said first cylinder from said first tube section after the wrinkling and compressing step.

12. The method of claim 11 wherein during said inverting step, said first tube section is only partially moved over said second tube section before said wrinkling and compressing step, and is then fully moved over said second tube section after said wrinkling and compressing step.

13. The method of claim 11 wherein said first cylinder is removed from said first tube section by moving the first cylinder opposite to the direction it was moved during said inverting step.

14. A method of making a scouring pad comprising the steps of:

forming a cylindrical fabric tube of scouring material, said forming comprising:

positioning a pair of cylinders on a piece of said material in spaced axially aligned relation, and rolling said material about said cylinders;

restricting said tube intermediate the ends thereof to form first and second tube sections, by gripping said tube sections over said cylinders and twisting said tube;

inverting said first tube section over and around said second tube section so that the restriction forms one end of said pad;

tucking and compressing said second tube section within said inverted first tube section to form a fabric core;

gathering said inverted first tube section around said fabric core to enclose said core and form the other end of said pad; and fastening said other end of said pad in its gathered position enclosing said core.

* * * * *